US006969222B1

(12) United States Patent
Koch

(10) Patent No.: US 6,969,222 B1
(45) Date of Patent: Nov. 29, 2005

(54) DEVICE FOR TRANSFERRING RODS

(75) Inventor: Elmar Koch, Eslohe (DE)

(73) Assignee: Tracto-Technik GmbH, (DE)

( * ) Notice: Subject to any disclaimer, the term of this patent is extended or adjusted under 35 U.S.C. 154(b) by 60 days.

(21) Appl. No.: 10/129,199

(22) PCT Filed: Nov. 3, 2000

(86) PCT No.: PCT/EP00/10866

§ 371 (c)(1),
(2), (4) Date: Jul. 16, 2002

(87) PCT Pub. No.: WO01/33035

PCT Pub. Date: May 10, 2001

(30) Foreign Application Priority Data

Nov. 5, 1999 (DE) ..... 199 53 458

(51) Int. Cl.[7] ..... B65G 59/06

(52) U.S. Cl. ..... 414/22.51; 739/741; 739/746.4; 739/797.7; 739/797.8; 739/797.9

(58) Field of Search ..... 198/370.01, 448, 198/468.2; 414/732, 746.4, 797.7, 797.8, 414/797.9

(56) References Cited

U.S. PATENT DOCUMENTS

| | | | | |
|---|---|---|---|---|
| 5,556,253 | A | 9/1996 | Rozendaal et al. | |
| 5,607,280 | A | 3/1997 | Rozendaal | |
| 5,954,209 | A | 9/1999 | Wurm et al. | |
| 6,408,954 | B1 * | 6/2002 | Price et al. | 175/52 |
| 6,419,029 | B2 * | 7/2002 | Bayer et al. | 172/52 |
| 6,533,046 | B2 * | 3/2003 | Mills et al. | 175/52 |
| 6,543,551 | B1 * | 4/2003 | Sparks et al. | 175/52 |
| 6,814,164 | B2 * | 11/2004 | Mills et al. | 175/52 |

FOREIGN PATENT DOCUMENTS

| | | |
|---|---|---|
| DE | 28 03 831 A1 | 8/1979 |
| WO | WO 00/75479 A1 | 12/2000 |
| WO | EP/00/10866 | 6/2001 |
| WO | EP/00/10866 | 12/2001 |

* cited by examiner

*Primary Examiner*—Khoi H. Tran
(74) *Attorney, Agent, or Firm*—Cook, Alex, McFarron, Manzo, Cummings & Mehler, Ltd.

(57) ABSTRACT

The invention relates to a rod transfer device for horizontal driving units for underground trenchless driving, having a storage container and a pivotable gripper, the gripper being arranged in such a way that the orbit of the gripper intersects both the transfer region of the storage container and the drilling axis.

22 Claims, 6 Drawing Sheets

DEVICE FOR TRANSFERRING RODS

The invention relates to a rod transfer device for horizontal driving units for underground trenchless driving and claims the priority provided by German patent application 199 53 458.6-24, to the content of which reference is made.

During horizontal driving, such as for example during trenchless underground drilling by means of a rotating driving unit, the rod which is located in the drilled bore is lengthened continuously by adding individual rod sections or shortened continuously by removing them, such as for example when a pilot bore is being widened. This is achieved by introducing the rod sections into the drilling axis and connecting them to the end of the rod string which is located in the ground. The rod sections may, for example, be arranged in a storage container in the region of the drilling unit, with an operator inserting the rod sections individually into the drilling axis.

Since the manual insertion of the rod sections involves a considerable risk of injury and generally requires additional manpower, various automatic rod magazines have been developed, which allow automatic introduction of the rod sections from the storage container into the drilling axis.

A rod magazine of this type is described, for example, in German laid-open specification 196 10 883. In this device, the storage container is arranged above the drilling axis and has a transfer compartment in its lower region. For removal, the transfer compartment, in which there is a rod section, is moved into the drilling axis, the rod section is fixed and the storage container is returned to its original position. However, this rod magazine is only suitable for low changing rates, since the entire storage container has to be displaced vertically for each rod transfer operation.

Another automatic rod transfer technique makes use of a gripper which conveys the rod sections from a storage container into the drilling axis. A rod magazine of this type is known, for example, from German laid-open specification 197 12 641. In rod magazines of this type, the gripper rotates the rod sections out of the storage container into a position in the vicinity of the drilling axis and then, as a result of the gripper being extended during a parallel displacement, the rod sections are moved into the drilling axis. A similar device is described in U.S. Pat. No. 5,556,253. These devices have the drawback that the design of the gripper must allow it not only to rotate but also to displace the drilling rod in the axial direction. Therefore, the pivot arm of the gripper has to have, for example, a special cylinder for axial displacement of the gripper.

In the device described in U.S. Pat. No. 5,607,280, the rod sections are pivoted directly out of a transfer position into the drilling axis by a gripper. This device has rod compartments which are arranged next to one another and contribute to reducing the noise caused by slipping of the rods. When a rod section is removed, the rod sections which lie above one another slip downward under the force of gravity. Since each rod compartment has its own transfer position, the rods located in the transfer position have to be moved into the pivot axis of the gripper in order to be available for pivoting into the drilling axis. For this purpose, the device described has a carriage with a plurality of pipe pockets, by which the rod sections can be successively displaced into the pivot axis of the gripper. Therefore, the device described avoids the design outlay involved in an axially displaceable gripper, but replaces this by an axially displaceable carriage, with the result that the parallel displacement is simply brought forward.

The invention is now based on the object of providing a rod transfer device for horizontal driving units in which the abovementioned drawbacks are avoided.

The object is achieved by a rod magazine as described in claim 1. Advantageous embodiments are given in the subclaims. The object is also achieved by the method claims.

The principle of the invention consists in arranging a gripper in such a way that the orbit of the gripper intersects both the rod transfer of the storage container for the rod elements and the drilling axis and in designing the gripper in such a way that, during pivoting into the rod transfer, it unlocks a locking element and thus releases rod transfer.

The device according to the invention makes it possible to introduce rod sections out of a storage container into a drilling axis using a two-stage process by means of a gripper. For this purpose, the gripper can be pivoted to and fro between two limit positions, namely between the drilling axis and the transfer position, without the gripper movement being interrupted, since the movement of the gripper into its limit position unlocks the locking element of the transfer position, while pivoting of the gripper out of the transfer position in turn causes locking to be brought about by the locking element. This avoids complex and sensitive multistep pivoting, since it is no longer necessary to prevent the rod sections from falling out of the shaft located in the transfer position by manually locking the transfer position before the gripper is pivoted out completely. Therefore, the gripper can be pivoted directly from the transfer position into the drilling axis and from the drilling axis into the transfer position.

It is particularly advantageous if the gripper, on its side which enters the transfer position first during the pivoting-in operation, has a lifting contour which lifts the rod section located in the transfer position and thereby facilitates unlocking of the locking element, since it can now be unlocked without there being any load.

In a further advantageous configuration of the invention, the locking element comprises a locking flap which is arranged pivotably beneath the transfer position and is held in the locking position by spring force. When the gripper is pivoted into the transfer position, this locking flap can then be pivoted out of the locking position, counter to the spring force, with the aid of a driver element arranged on the gripper, so that the transfer position is released and a rod section can move into the receptacle of the gripper.

Furthermore, the device according to the invention may having lifting hydraulics in the region of the transfer position. This makes it possible, when the rod is being dismantled, to move rod sections which have been pivoted into the transfer position out of the gripper receptacle into the rod shaft counter to the force of gravity.

The storage container preferably has a plurality of rod shafts and can be displaced in the horizontal direction, so that each shaft can be moved into the transfer position.

The invention is explained in more detail below with reference to an exemplary embodiment illustrated in the drawing, in which:

FIG. 1 diagrammatically depicts the device according to the invention for transferring rods on a drilling platform;

Figure 1:
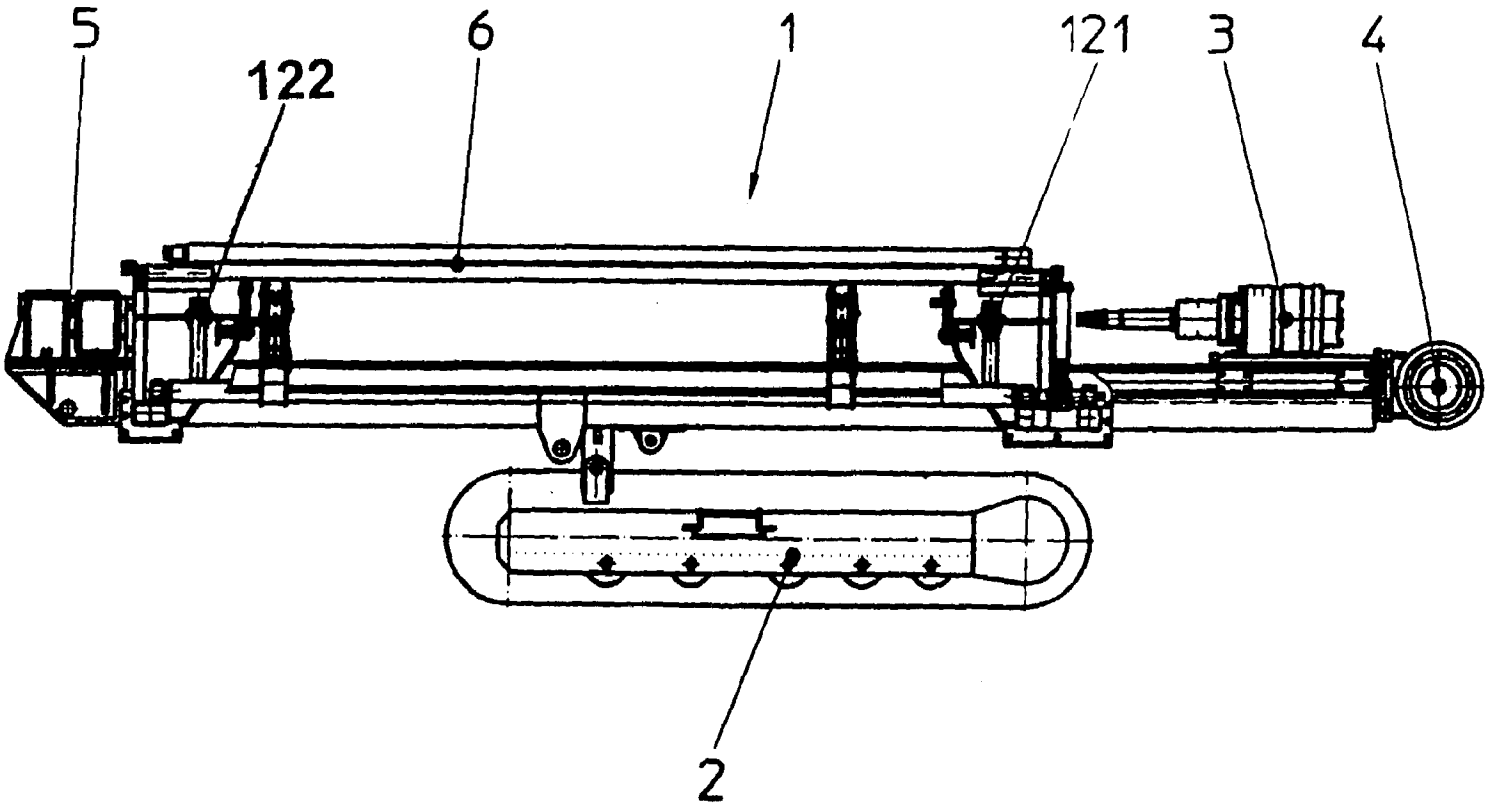
Figure 2:
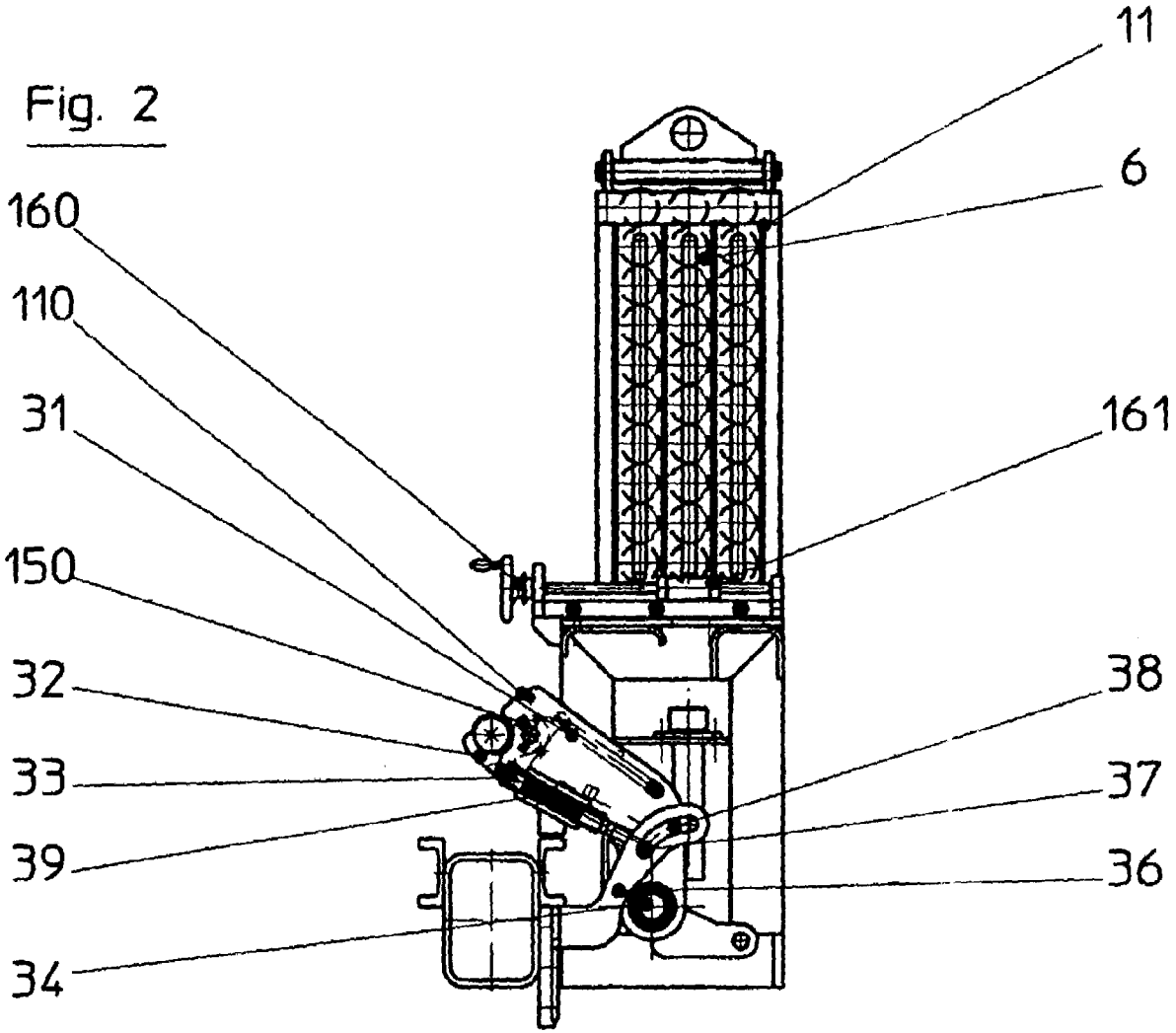
FIG. 2 shows a section through the device shown in FIG. 1 during the transfer of the rod section into the drilling axis with storage container.
Figure 3:
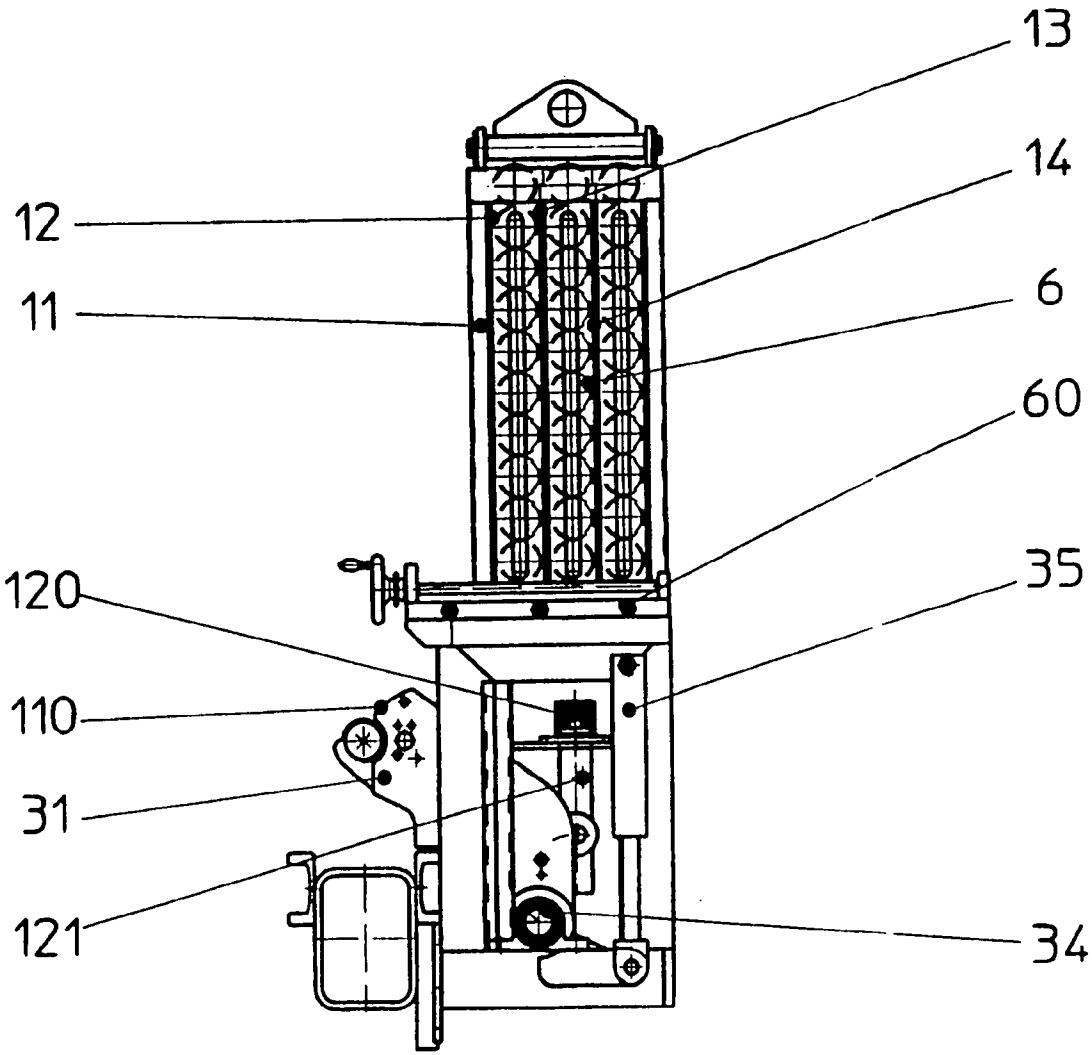
FIG. 3 shows a front view of the device according to the invention.
Figure 4:
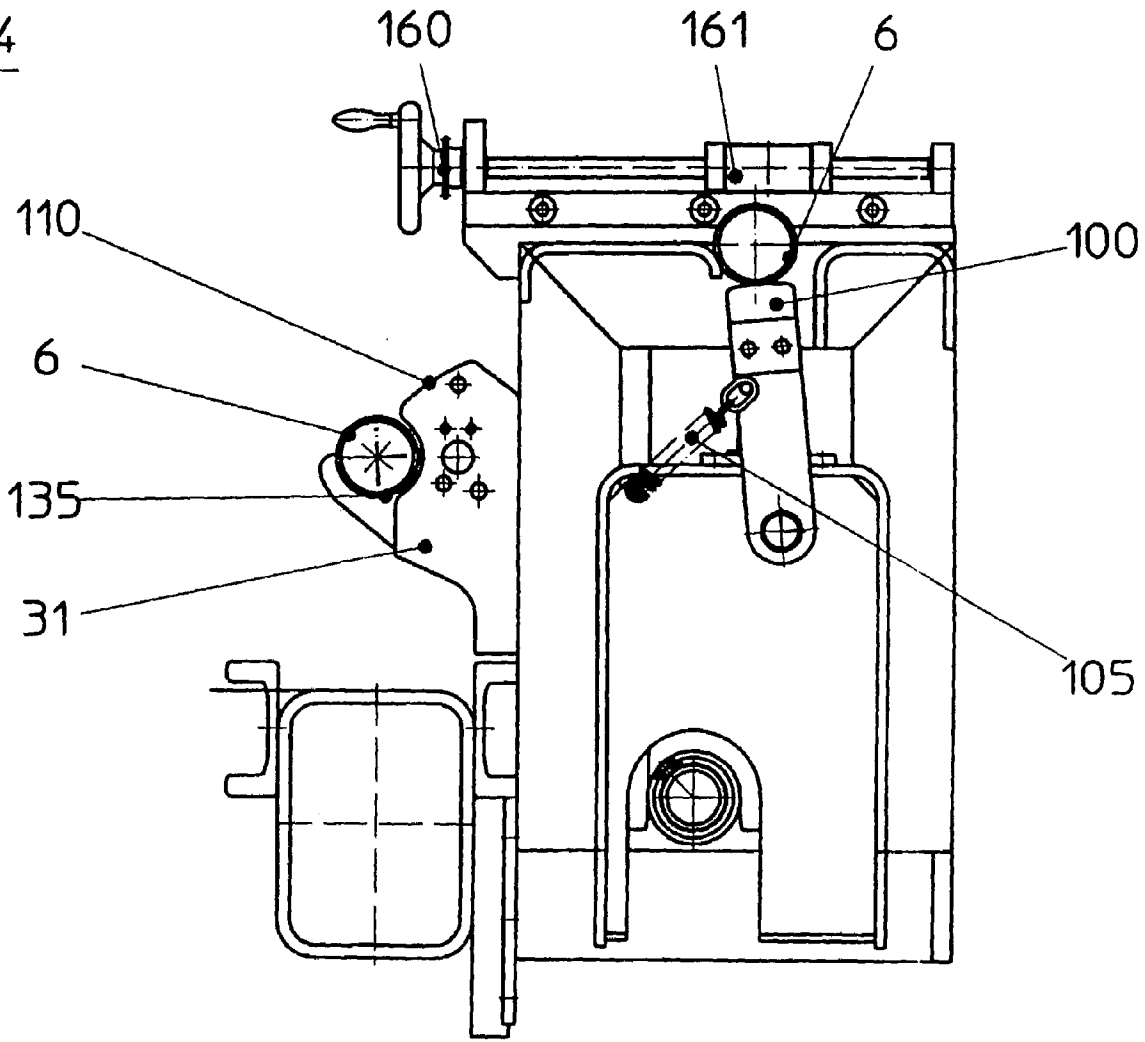
FIG. 4 shows a detailed view of the locking element.
Figure 5:
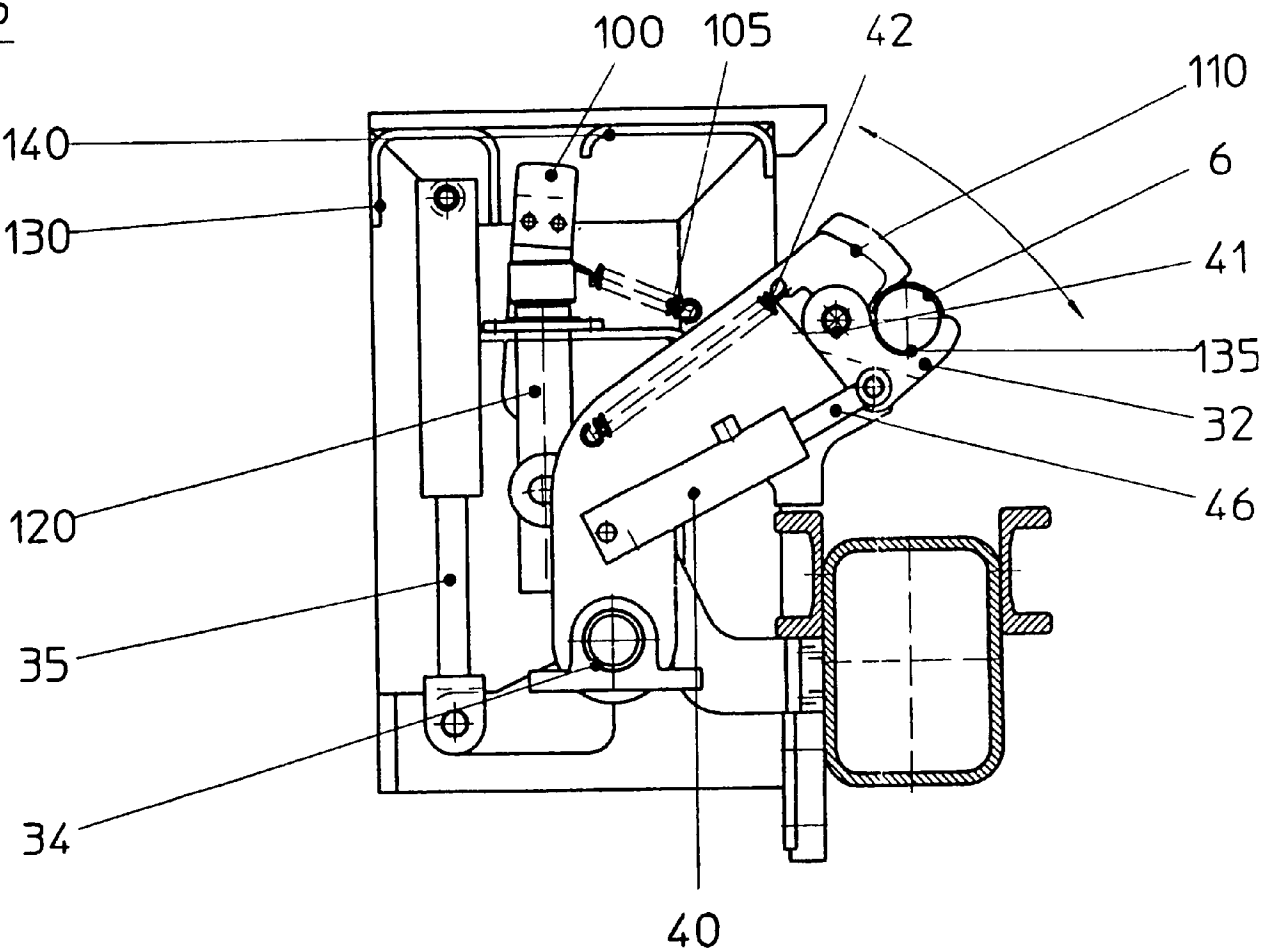
FIG. 5 shows a detailed view of the gripper with locking element.
Figure 6:
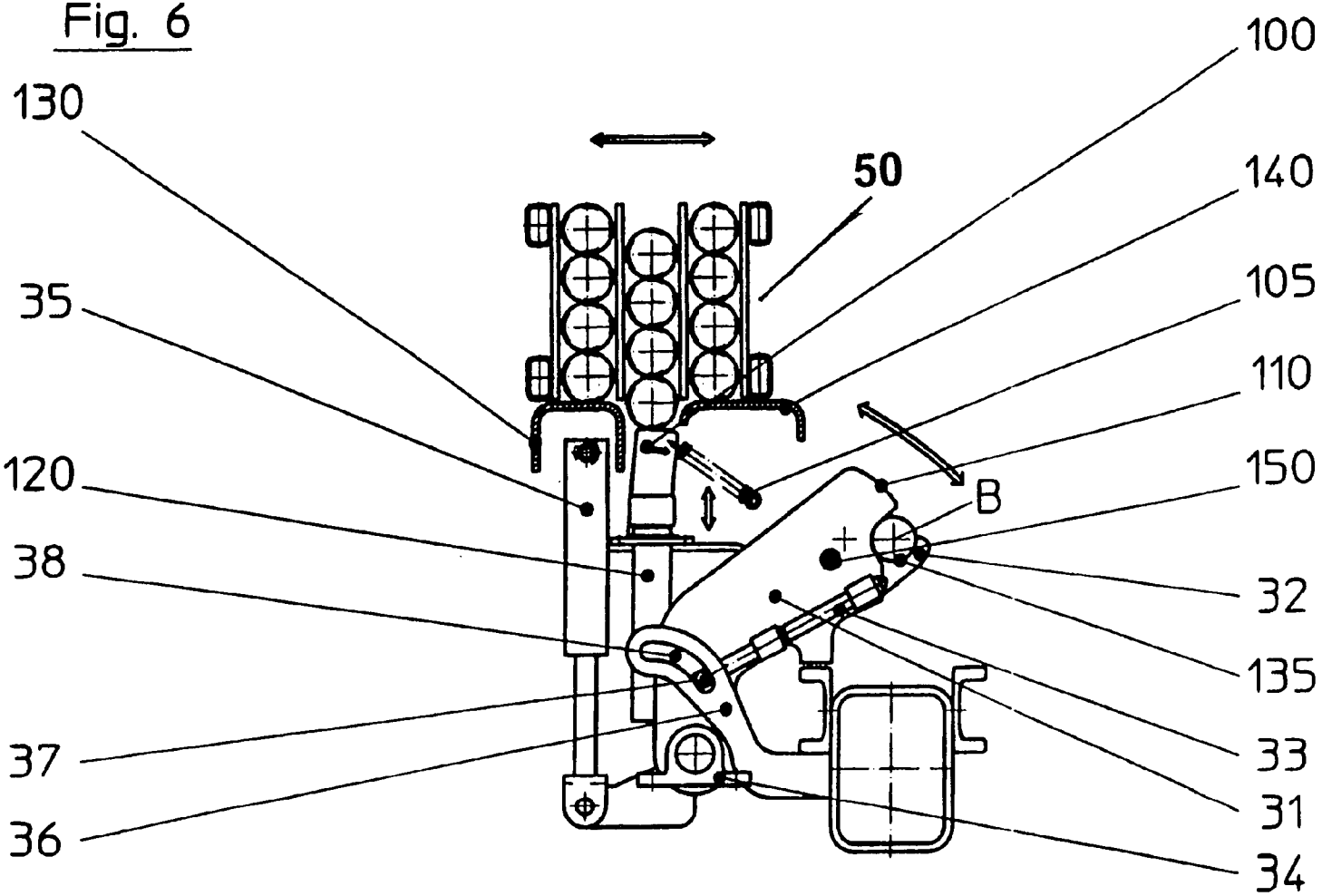
FIG. 6 shows a further detailed view of the gripper with locking element and storage container.

The rod transfer device 1 according to the invention is arranged on a tracked vehicle 2 having a rotary motor 3 and an advancing motor 4, and also a crushing and removing device 5. FIG. 1 shows the transfer arrangement, which includes a storage container in the form of a rod box, without storage container, so that rod sections 6 can be seen.

FIGS. 2 to 5 show the rod box 11 with rod sections 6 arranged in compartments which are divided by partitions 12 to 14.

Beneath the rod box 11 there is a lifting device 120 in the form of lifting cylinders 121, 122. The rod sections can be moved between an upper position and a lower position with the aid of the lifting cylinders.

In the upper position, the lifting cylinder closes off the transfer position of the rod box 11 and thereby prevents rod sections 6 which are in the transfer position and arranged above one another from falling out.

In the front and rear regions of the rod transfer device 1 there is in each case one gripper 31 having a lifting contour 110, a hook 32 and a locking pin 33. The gripper is arranged on a shaft 34 in such a manner that it can rotate with the aid of a pivoting cylinder 35. The lifting contour 110 is arranged in such a way that a rod section which is located in the transfer position of the rod box 11 and is resting on a locking flap 110 is lifted when the gripper pivots into the transfer position. The locking flap 100, which is then free of the rod section 6, during further pivoting of the gripper 31 is pivoted out of the transfer position, counter to the force of a spring 105, by a driver bolt 150 arranged on the gripper frame, so that the rod section on the lifting contour 110 slides into the rod receptacle 135 of the gripper 31.

The locking pin 33 is arranged in a guide 36 and has its foot 37 arranged in a curved path 38. The locking pin 33 follows the curved path 38 while the gripper 31 is pivoting in the guide 36. The hook 32 can be rotated about a shaft 41 by means of a hook cylinder 40 and is otherwise held in its "closed" position by a tension spring 42.

In order for the rod section 6 to be pivoted into the drilling axis B, the gripper is, with the aid of the pivoting cylinder 35, displaced beneath the rod box 11 into the transfer position of the rod box 11. With the aid of the lifting contour 110, the lower rod section is lifted by the pivoting operation, and the locking flap 100 is pressed out of the transfer position by the driver bolt 131 arranged on the gripper 31. As soon as the gripper 31 has reached its receiving position below the transfer position, the rod section slides over the lifting contour 110 into the gripper receptacle 135.

In this position, the locking pin 33 is in its locking position, since the curved path 38, on account of its geometry, causes the locking pin 33 to project in this position. At the same time, the hook 32 can be in the "open" position as a result of the hook cylinder 40. During the pivoting of the gripper into the transfer position, the bottom rod section 6 follows the force of gravity and slides into the receptacle 135 of the gripper 31. As soon as the first rod section 6 comes to lie in the receptacle of the gripper 31, the gripper is pivoted toward the drilling axis with the aid of the pivoting cylinder 35. While the gripper 31 is pivoting out beneath the rod box 11, the hook 32 is moved out of its "open" position into its "closed" position by means of a switch (not shown) which actuates the hook cylinder 40. At the same time, the locking pin 33 is retracted as a result of the foot 37 of the locking pin following the surface of the curved track 38.

While the gripper 31 is pivoting out beneath the rod box, at the same time the locking flap 100 is released again and is moved into the locking position by a spring 10S in order to prevent a second rod section 6 from falling out. The choice of arrangement of the driver bolt 150 makes it possible to define the time in relation to the position of the lifting contour at which the locking flap pivots into the transfer position in such a way that the locking flap can pivot in without being subject to any load and, at the same time, the rod section cannot drop out. The same applies to the pivoting-out operation, in the reverse order.

As soon as the gripper 31 together with its receptacle and the rod section 6 located therein is in the drilling axis B, the rod section can be connected to the rod located in the drilling axis and the rotary motor 3. In the process, the hook cylinder 40 can be released in such a manner that although the tension spring 42 holds the hook in a "closed" position, it still allows axial displacement of the rod section 6 in order for it to be screwed in.

In a preferred embodiment, there is a lifting cylinder which can be displaced into the transfer position. After the gripper has been pivoted into the transfer position during dismantling of the rod, the lifting cylinder 121, 122 which is located directly beneath the transfer position is lifted, or lowered if the rod is being constructed, so that the rod section which is in the transfer position moves out of or into the receptacle of the gripper. As soon as a rod compartment has been filled or emptied, the lifting cylinder is displaced into the transfer position of the rod box, so that the latter is closed. Then, the rod box is displaced by one shaft width horizontally with the aid of a mechanism 160, 161, until the next shaft has moved into the transfer position.

The rod compartments are preferably empty from the inside outward, starting from the drilling axis. This allows the operator to observe the filled occupancy of the rod box 11 via a viewing window 50.

The device according to the invention also allows a rod section 6 to be inserted by hand, for example if the number of rod sections 6 in the rod box 11 is insufficient to complete the drilling operation. For this purpose, the gripper 31 is pivoted all the way under the rod box 11, so that it projects from beneath the rod box 11 on the side which is remote from the drilling axis. In this position, a rod section can easily be inserted by hand and pivoted into the drilling axis B in the manner described.

In its lower region, the rod box 11 has bushes 60 for the insertion of locking bolts, which ensures that the rod box 11 can be removed and transported without any problems.

What is claimed is:

1. A rod transfer device for horizontal driving units for underground trenchless driving, having a storage container with a transfer position to which rods are supplied successively from the storage container and an orbiting pivotable gripper;

said gripper being arranged in such a way that the orbit of the gripper intersects both the transfer position of the storage container and a drilling axis (B);

said drilling axis being positioned at a distance from the storage container;

characterized in that said gripper, when it is pivoted into the transfer position, unlocks a locking element of the rod transfer device which locks the rod in the transfer position and that the gripper has a lifting contour which, when the gripper is pivoted into the transfer position, lifts a rod section, which is in the transfer position, before a rod receptacle of the gripper, which is located beneath the storage container, passes into the transfer position of the storage container.

2. The device as claimed in claim 1, characterized in that the storage container is arranged alongside the drilling axis (B) and above the horizontal plane defined by the drilling axis (B).

3. The device as claimed in claim 1, characterized in that the storage container is arranged such that it is displaceable in a horizontal direction relative to the transfer position.

4. The device as claimed in claim 1, characterized in that the gripper is designed in such a manner that it can pivot out beneath the storage container to the opposite side of the storage container from the drilling axis (B), in order to allow a rod section to be inserted by hand.

5. The device as claimed in claim 1, characterized in that the gripper has a hook which is pre-stressed in its closed position by a compression or tension element of the rod transfer device.

6. The device as claimed in claim 1, characterized in that the gripper has an axially displaceable locking element, whereas the displacement of the locking element is controlled by means of a curved track of the transfer device.

7. The device as claimed in claim 1, characterized in that the locking element is arranged with a foot of the rod transfer device in a guide of the rod transfer device.

8. The device as claimed in claim 5, characterized in that the hook, during pivoting of the gripper beneath the storage container, is automatically moved into its open position.

9. The device as claimed in claim 6, characterized in that the curved track is designed in such a way that the locking element, during pivoting beneath the storage container, is in its locking position when the gripper reaches the transfer position, while it is retracted when the gripper pivots from the transfer position to the drilling axis.

10. The device as claimed in claim 1, characterized by a lifting device of the rod transfer device for lifting and lowering the rod sections located in the transfer position.

11. The device as claimed in claim 1, characterized in that the storage container has vertical partitions which form individual storage compartments with a lower closure area having closure elements, the closure elements forming a transfer position for the rod transfer, and the storage container being mounted in such a manner that it can be displaced horizontally on the closure elements, in order to move the storage compartments into the transfer position.

12. A rod transfer device for horizontal driving units for underground trenchless driving, having a storage container with a transfer position to which rods are supplied successively from the storage container and an orbiting pivotable gripper;

said gripper being arranged in such a way that the orbit of the gripper intersects both the transfer position of the storage container and a drilling axis (B);

said drilling axis being positioned at a distance from the storage container characterized in that the gripper, when it is pivoted into the transfer position, unlocks a locking element of the rod transfer device which locks the rod in the transfer position and that the locking element is designed as a flap which is held in a locking position in a region of the transfer position of the storage container by the force of a spring of the transfer device and is shifted out of the locking position by a driver element which is part of the gripper when the gripper pivots into the transfer position.

13. The device as claimed in claim 12, characterized in that the storage container is arranged alongside the drilling axis (B) and above the horizontal plane defined by the drilling axis (B).

14. The device as claimed in claim 12, characterized in that the storage container is arranged displaceable in a horizontal direction relative to the transfer position.

15. The device as claimed in claim 12, characterized in that the gripper is designed in such a manner that it can pivot out beneath the storage container to the opposite side of the storage container from the drilling axis (B), in order to allow a rod section to be inserted by hand.

16. The device as claimed in claim 12, characterized in that the gripper has a hook which is pre-stressed in its closed position by a compression or tension element of the rod transfer device.

17. The device as claimed in claim 12, characterized in that the gripper has an axially displaceable locking element, whereas the displacement of the locking element is controlled by means of a curved track of the transfer device.

18. The device as claimed in claim 12, characterized in that the locking element is arranged with a foot of the rod transfer device in a guide of the rod transfer device.

19. The device as claimed in claim 16, characterized in that the hook, during pivoting of the gripper beneath the storage container, is automatically moved into its open position.

20. The device as claimed in claim 17, characterized in that the curved track is designed in such a way that the locking element, during pivoting beneath the storage container, is in its locking position when the gripper reaches the transfer position, while it is retracted when the gripper pivots from the transfer position to the drilling axis.

21. The device as claimed in claim 12, characterized by a lifting device of the rod transfer device for lifting and lowering the rod sections located in the transfer position.

22. The device as claimed in claim 12, characterized in that the storage container has vertical partitions which form individual storage compartments with a lower closure area having closure elements, the closure elements forming a transfer position for the rod transfer, and the storage container being mounted in such a manner that it can be displaced horizontally on the closure elements, in order to move the storage compartments into the transfer position.

* * * * *